US010299546B2

(12) United States Patent
Teal

(10) Patent No.: US 10,299,546 B2
(45) Date of Patent: May 28, 2019

(54) WRISTBANDS FOR SECURING IMPLEMENTS AND TOOLS AND METHODS OF USING

(71) Applicant: Sandra Teal, Chesterton, IN (US)

(72) Inventor: Sandra Teal, Chesterton, IN (US)

(73) Assignee: Sandra Teal, Chesterton, IN (US)

( * ) Notice: Subject to any disclaimer, the term of this patent is extended or adjusted under 35 U.S.C. 154(b) by 204 days.

(21) Appl. No.: 15/582,018

(22) Filed: Apr. 28, 2017

(65) Prior Publication Data

US 2018/0310674 A1 Nov. 1, 2018

(51) Int. Cl.

*A44C 5/00* (2006.01)
*B26B 29/04* (2006.01)
*A45F 5/00* (2006.01)

(52) U.S. Cl.

CPC ..... *A44C 5/0007* (2013.01); *A44C 5/003* (2013.01); *A45F 5/00* (2013.01); *B26B 29/04* (2013.01); *A45F 2005/008* (2013.01); *A45F 2200/0575* (2013.01)

(58) Field of Classification Search

CPC ..... A44C 5/00; A44C 5/0007; A44C 5/003; A44C 5/0046; A45F 2005/008; A45F 2200/05; A45F 2200/0575; B26B 29/04; B25H 3/00

USPC ..... 224/219, 221, 222, 223; 206/373

See application file for complete search history.

(56) References Cited

U.S. PATENT DOCUMENTS 2,349,107 A * 5/1944 Murtaugh ..... A45F 5/021 224/239
4,901,464 A * 2/1990 Banoun ..... F41A 29/00 206/315.11
5,309,328 A 5/1994 Lum
6,213,365 B1 * 4/2001 Stocke ..... A41D 13/0012 224/223
7,048,162 B2 * 5/2006 Frye ..... A45D 29/20 206/373
2002/0145027 A1 10/2002 Godshaw et al.
2005/0082323 A1 * 4/2005 O'Hair ..... A45C 1/04 224/219
2009/0205996 A1 * 8/2009 Celis ..... A44C 5/003 206/570
2010/0193557 A1 * 8/2010 Clinton ..... A45F 3/02 224/576

FOREIGN PATENT DOCUMENTS

WO 2005018868 3/2005

OTHER PUBLICATIONS

European Search Report dated Sep. 13, 2018 for European Application No. 18169976.0.

* cited by examiner

*Primary Examiner* — Corey N Skurdal
(74) *Attorney, Agent, or Firm* — Hartman IP Global Law; Gary M. Hartman; Domenica N.S. Hartman

(57) ABSTRACT

A band adapted for holding implements and tools when the band is secured around a user's arm. The band includes a body delimited by oppositely-disposed longitudinal ends configured to be secured together and by edges that are laterally spaced apart from each other. The edges each have arcuate portions and, upon fastening the longitudinal ends together, the body acquires a circular shape having one axial end that is larger than the other. The band further includes sleeves located on an outer surface of the body and arranged side-by-side so that each sleeve extends laterally across the outer surface, and straps secured to the body and sized to accommodate and secure implements or tools of different sizes. At least some of the straps span one or more of the sleeves, and the straps are disposed at different angles so as not to be parallel to each other.

20 Claims, 6 Drawing Sheets

WRISTBANDS FOR SECURING IMPLEMENTS AND TOOLS AND METHODS OF USING

BACKGROUND OF THE INVENTION

The present invention generally relates to accessories that can be worn by the user and are adapted to secure and carry articles.

BRIEF DESCRIPTION OF THE INVENTION

The present invention provides accessories in the form of bands that are configured to be worn on the lower arm of a user and to secure a variety of implements and tools of types used in various occupations and industries, including but not limited to implements and tools used in the beauty industry, for example, when styling hair and applying cosmetics.

According to a first aspect of the invention, a band includes a body delimited by oppositely-disposed first and second longitudinal ends and by first and second edges that are between the first and second longitudinal ends and spaced apart from each other in a lateral direction of the body. The first and second edges each have arcuate portions and, upon fastening the first and second longitudinal ends together, the body acquires a circular shape having first and second axial ends that are defined respectively by the first and second edges and the first axial end is larger than the second axial end. The band further includes means for releasably securing the first and second longitudinal ends together, sleeves located on an outer surface of the body and arranged side-by-side in a row so that each sleeve extends laterally across the outer surface, and straps secured to the body and sized to accommodate and secure implements or tools of different sizes. Each of the sleeves has opposite ends that are open to permit an implement or tool to be placed therein from either of the opposite ends and protrude from both of the opposite ends. At least some of the straps span one or more of the sleeves. The straps are disposed at different angles relative to the first and second edges of the body so as not to be parallel to each other.

According to a second aspect of the invention, a method of using a band such as described above includes wrapping the band around the user's forearm adjacent the wrist such that the second edge of the body is adjacent the wrist and the body acquires the circular shape thereof. The first and second longitudinal ends of the body are then secured together so that the first and second longitudinal ends are located at an anterior side of the forearm and the wrist. Thereafter, an implement or tool can be placed in one of the sleeves so that the implement or tool protrudes from both of the opposite ends of the sleeve, and another implement or tool can be placed in one of the straps such that the strap orients the implement or tool at a different angle relative to the implement or tool secured by the sleeve.

Various aspects and advantages of the invention will be better appreciated from the following detailed description.

DETAILED DESCRIPTION OF THE INVENTION

Figure 1:
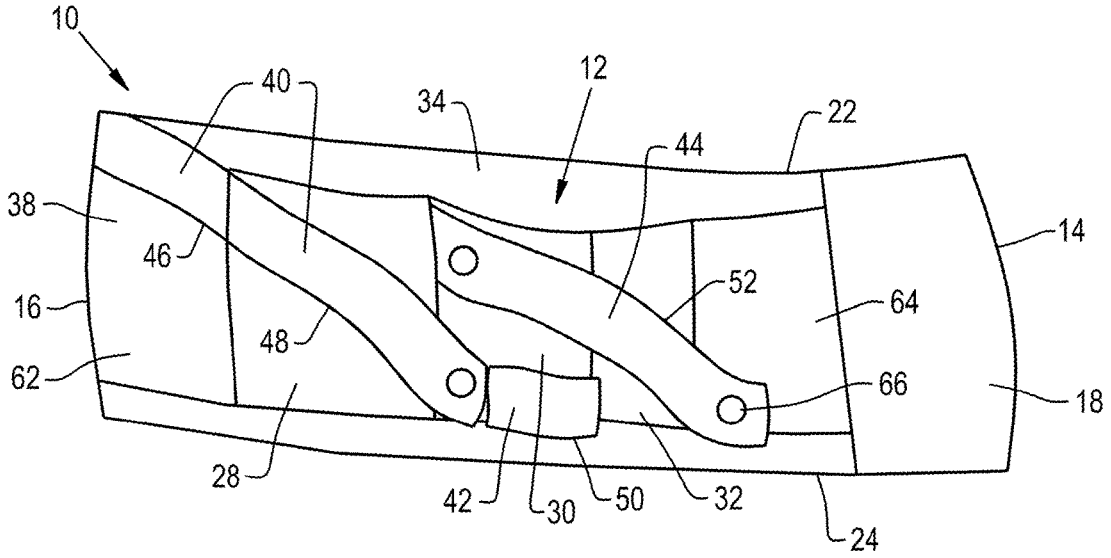
FIGS. 1 and 2 schematically represent front and rear views of a first embodiment of a band configured to secure implements and tools of various types and suitable for use in the beauty industry.

FIGS. 1 through 12 schematically represent nonlimiting embodiments of bands 10, 110, and 210 within the scope of the invention. The bands 10, 110, and 210 are particularly configured to secure a variety of implements and tools (hereinafter, "implements") of types used in the beauty industry, including but not limited to implements used for styling hair and applying cosmetics. However, it is understood that the bands 10, 110, and 210 could be used by individuals in various occupations and industries, including tattoo artists, manicurists, medical personnel, etc. Each band 10, 110, and 210 is flexible and has oppositely-disposed longitudinal ends configured to be securable together so that the bands 10, 110, and 210 can be wrapped around the arm, preferably the forearm and wrist, of a user to acquire a generally circular shape, with one of the axial ends being larger than the other. As such, the bands 10, 110, and 210 will be referred to below as wristbands, though it should be understood that the wristbands 10, 110, and 210 are not limited to being worn around the wrist. The wristbands 10, 110, and 210 are depicted and will be described as specially configured for a right-handed user, meaning that the wristbands 10, 110, and 210 are configured to be worn on a user's left arm and implements are secured with the wristbands 10, 110, and 210 for retrieval with the user's right hand. As such, a wristband dedicated to a left-handed user could be a mirror image of the wristbands 10, 110, and 210 shown in the drawings, though it is foreseeable that a left-handed person would also find the wristbands 10, 110, and 210 shown in the drawings to be convenient to use.

The wristband 10 represented in FIGS. 1 through 4 has a main body 12 in the form of a flat panel or sheet having a longitudinal dimension that is greater than its lateral width, for example, by a ratio of about 2:1. The wristband 10 has oppositely-disposed first and second longitudinal ends 14 and 16 that can be joined together, for example, with complementary hook-and-loop fasteners 18 and 20 (for example, VELCRO®) or other suitable temporary fasteners so that the ends 14 and 16 can overlap and be secured together and the wristband 10 can acquire a shape and adjustable size compatible with being worn around the forearm of the user. The body 12 is delimited between its longitudinal ends 14 and 16 by first and second longitudinal edges 22 and 24 that are laterally spaced apart from each other. Each edge 22 and 24 is formed to have an arcuate shape along its entire extent between the longitudinal ends 14 and 16, with the edge 24 being slightly longer than the edge 22 so that, upon fastening the ends 14 and 16 together, the wristband 10 acquires a generally frustoconical shape whose axial ends are defined by the edges 22 and 24, with the larger end formed by the longer edge 24 to accommodate a relatively larger region of the user's arm, for example, the forearm above the user's wrist. Because the wristbands 10, 110, and 210 share the characteristic of having relatively shorter and longer edges, the edges 22 and 24 of the wristbands 10, 110, and 210 will also be referred to herein as distal and proximal edges 22 and 24, corresponding to the anatomical distal and proximal directions of the user's arm. When attached together, the overlapping ends 14 and 16 of the wristband 10 are preferably positioned on the user's forearm to be on the anterior side of the forearm and wrist.

Figure 2:
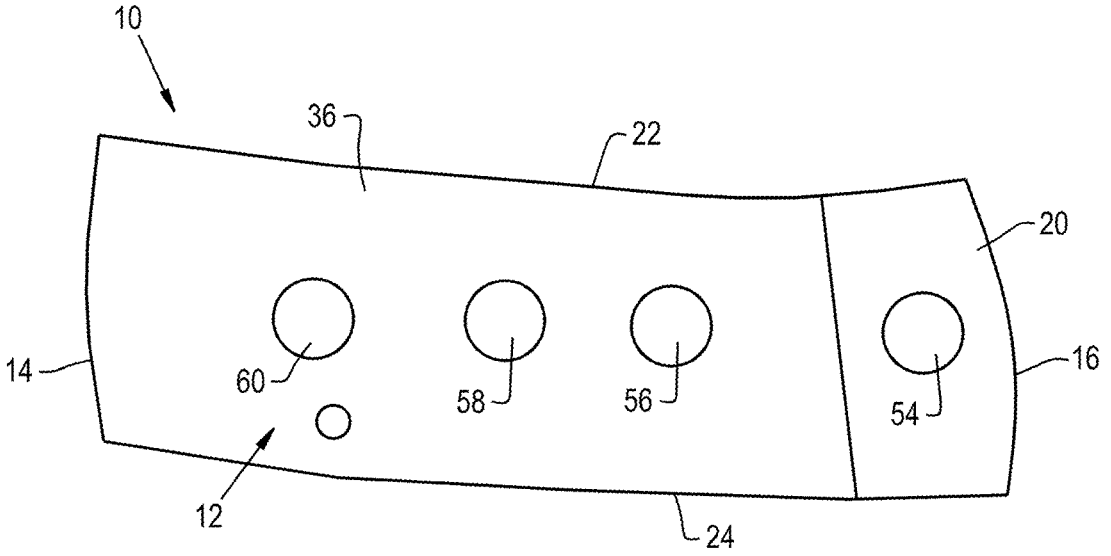
Figure 3:
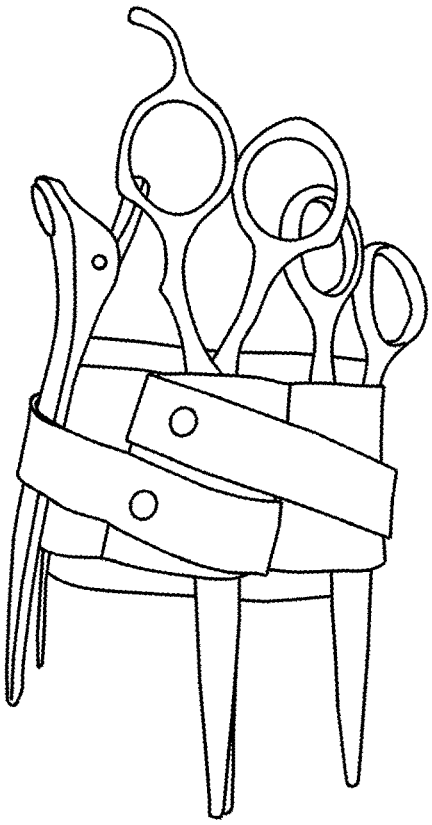
FIGS. 3 and 4 represent front and rear views, respectively, of the band of FIGS. 1 and 2 as configured when worn by a user and shows a variety of implements and tools secured with the band.

The wristband 10 is represented in FIGS. 1 through 4 as having multiple sleeves 28, 30, and 32 located on a surface of the body 12 designated as the outer surface 34, which is located opposite an inner surface 36 (FIG. 2) of the body 12 placed against the skin when worn by the user. In FIGS. 1 through 4, the sleeves 28, 30, and 32 are shown arranged side-by-side so that each sleeve 28, 30, and 32 extends laterally across the outer surface 34. The sleeves 28, 30, and 32 are shown in FIGS. 1 and 3 as being in a single row, roughly parallel to each other, and roughly perpendicular to the edges 22 and 24 of the body 12. The sleeves 28, 30, and 32 are represented as being formed by a strip 38 of material attached to the outer surface 34 of the body 12 and having a lateral width that is less than that of the body 12. Opposite ends of each sleeve 28, 30, and 32 are preferably open to permit implements to be placed in the sleeves 28, 30, and 32 from either end and protrude from both ends of the sleeves 28, 30, and 32. The material strip 38 is shown as attached to the outer surface 34 of the body 12 so that the sleeves 28, 30, and 32 are of roughly equal lengths and widths. As a result of the orientations of the sleeves 28, 30, and 32 relative to the edges 22 and 24, implements placed in the sleeves 28, 30, and 32 tend to be oriented roughly parallel to the user's forearm when the wristband 10 is worn.

The wristband 10 is seen in FIGS. 1 through 4 as further comprising straps 40, 42, and 44. Each strap 40, 42, and 44 is secured to the body 12 and/or the strip 38 with stitches, rivets, etc., to form loops 46, 48, 50, and 52 that are sized to accommodate and secure implements of different sizes, as evident from FIGS. 3 and 4. The center strap 42 spans a single sleeve 30, the strap 40 spans one sleeve 28 and a region 62 of the body 12 that lacks a sleeve, and the strap 44 spans two sleeves 30 and 32. The straps 40, 42, and 44 are disposed at different angles relative to the edges 22 and 24 of the body 12 and therefore are not parallel to each other, with the result that implements placed in their corresponding loops 46, 48, 50, and 52 tend to be oriented at different angles to the user's forearm. The center strap 42 is oriented roughly parallel to the longitudinal length of the body 12 and generally parallel to the edges 22 and 24, with the result that, similar to implements placed in the sleeves 28, 30, and 32, implements placed in its loop 50 tend to be oriented roughly parallel to the user's forearm. The two remaining straps 40 and 44 are disposed at angles that are not parallel or perpendicular to the longitudinal length of the body 12, with the result that implements placed in their corresponding loops 46, 48, and 52 tend to be oriented at angles other than parallel to the user's forearm, and therefore also at angles different from each other and different from implements placed in the sleeves 28, 30, and 32. When worn on the left wrist with the shorter distal edge 22 closer to the hand, the loops 40 and 44 are located over the ulna and radius bones of the forearm, respectively. The orientations of the straps 40 and 44 facilitate the user's ability to withdraw an implement from the loop 52 (located over the radius) by pulling the implement in a distal direction toward the hand and in a generally medial direction, and to withdraw an implement from the loop 48 (located over the ulna) by pulling the implement in a generally medial but proximal direction away from the hand.

Figure 4:
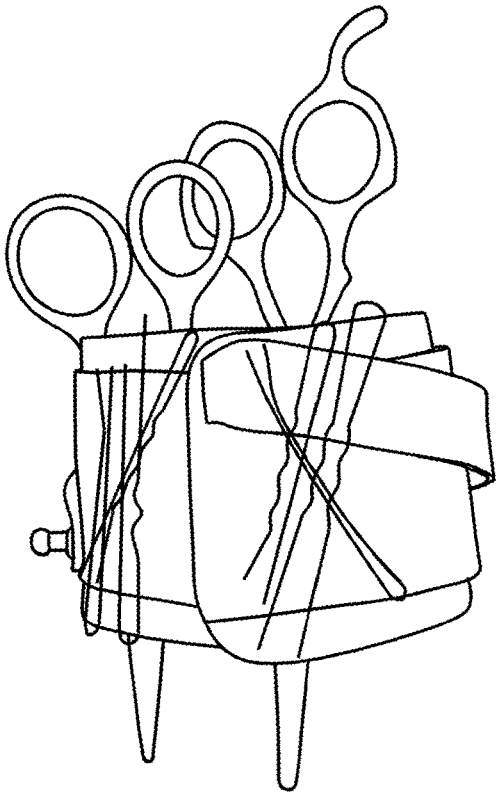
Figure 5:
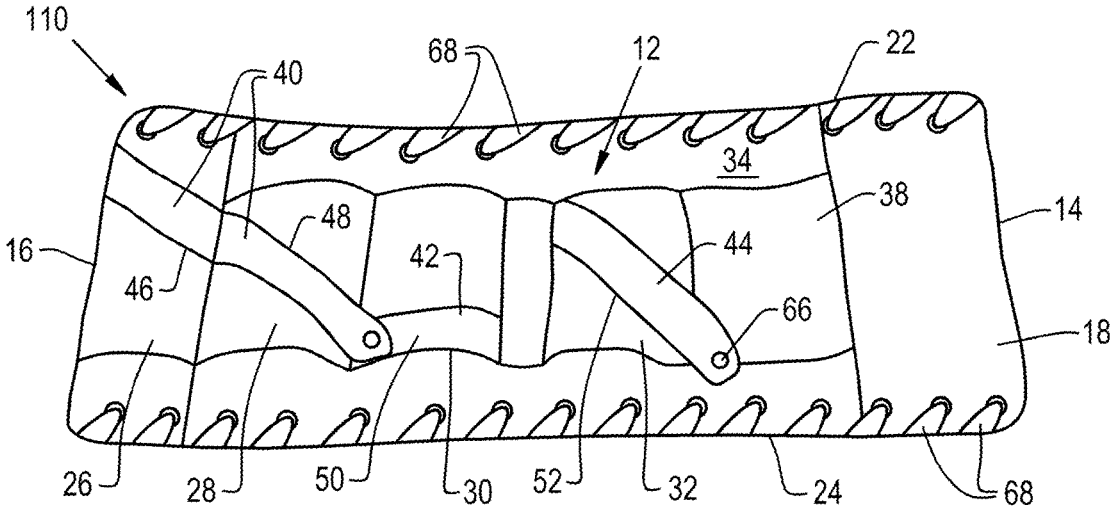
FIGS. 5 and 6 schematically represent front and rear views of a second embodiment of a band configured to secure implements and tools of various types and suitable for use in the beauty industry.

FIG. 2 represents the wristband 10 as having magnets 54, 56, 58, and 60 attached to the body 12 to assist in securing implements formed of magnetic materials. The magnets 54, 56, 58, and 60 can be incorporated into the body 12 in various ways, for example, by constructing the body 12 to have a multilayer construction and securing the magnets 54, 56, 58, and 60 between plies of the body 12. Two of the magnets 56 and 58 are shown as being aligned with the sleeves 30 and 32, and the remaining two magnets 54 and 60 are positioned on the body 12 so as to be aligned with two regions 62 and 64 of the outer surface 34 where sleeves and straps are not located. As depicted in FIGS. 3 and 4, the magnets 56 and 58 can be used to help secure relatively heavy implements such as scissors. To reliably secure relatively heavy objects, the magnets 54, 56, 58, and 60 are preferably permanent magnets formed of a rare-earth alloy. As depicted in FIGS. 3 and 4, the magnets 54 and 60 can be used to secure relatively lighter implements, such as bobby pins, which do not require the additional retention capability of a sleeve or strap. The strap 44 is shown attached to the body 12 adjacent the longer proximal edge 24 with a post 66 that can be used to open bobby pins.

In view of functional similarities between the wristbands 10, 110, and 210, the following discussion of the wristbands 110 and 210 represented in FIGS. 5 through 12 will focus primarily on aspects of the wristbands 110 and 210 that differ from the wristband 10 in some notable or significant manner. Other aspects of the wristbands 110 and 210 not discussed in any detail can be, in terms of structure, function, materials, etc., essentially as was described for the first embodiment. For convenience, identical reference numerals are used in FIG. 5 through 12 to denote the same or functionally related elements described for the wristband 10 of FIGS. 1 through 4.

Figure 6:
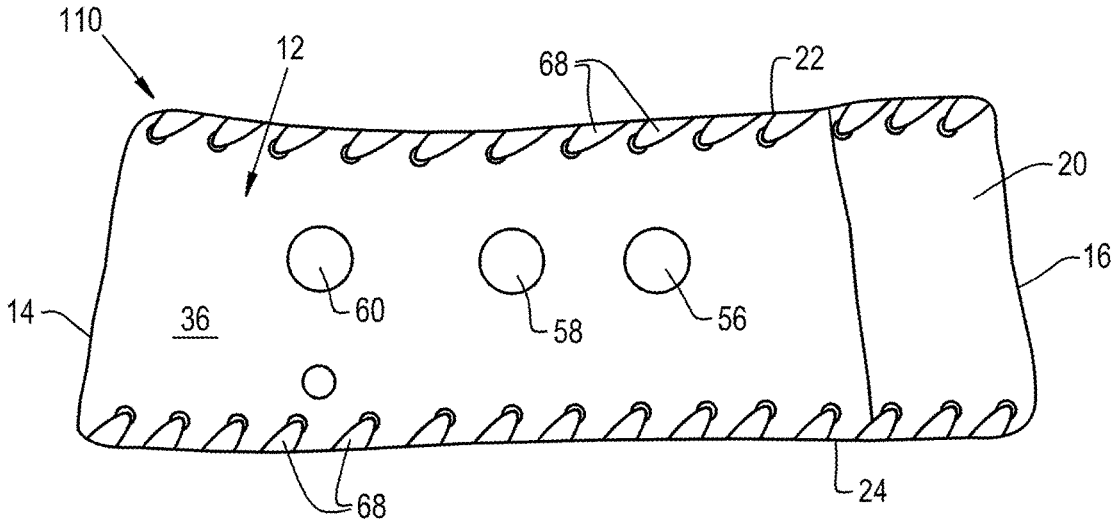
Figure 7:
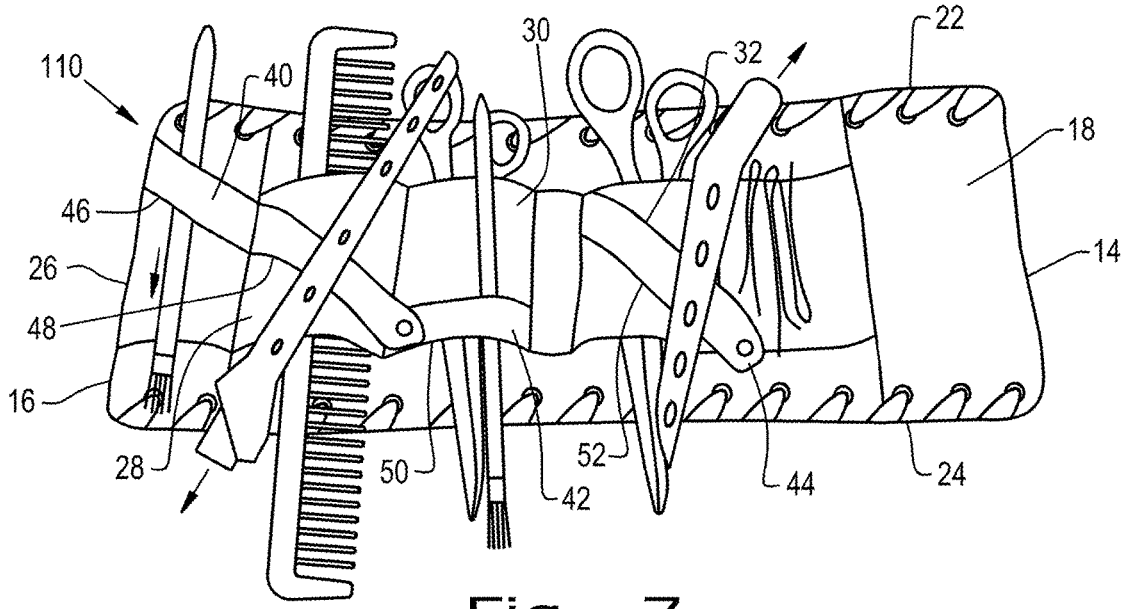
FIG. 7 schematically represents a variety of implements and tools secured to the band of FIGS. 5 and 6.
Figure 8:
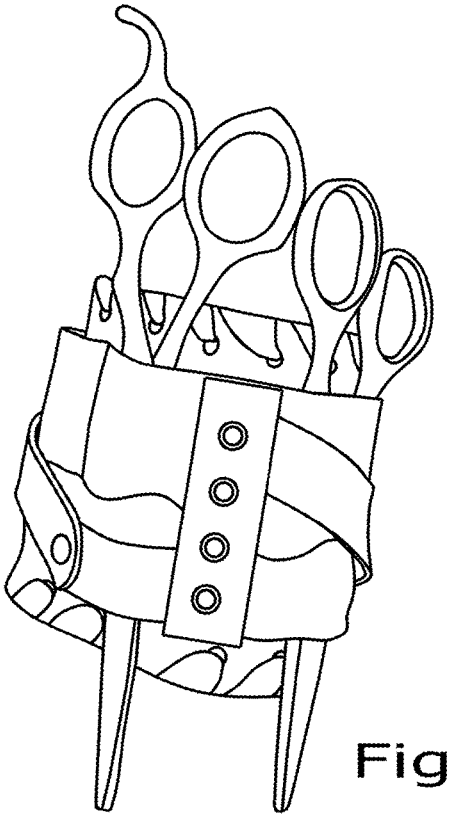
FIGS. 8 and 9 represent front and rear views, respectively, of the band of FIGS. 5 through 7 as configured when worn by a user and shows a variety of implements and tools secured with the band.
Figure 9:
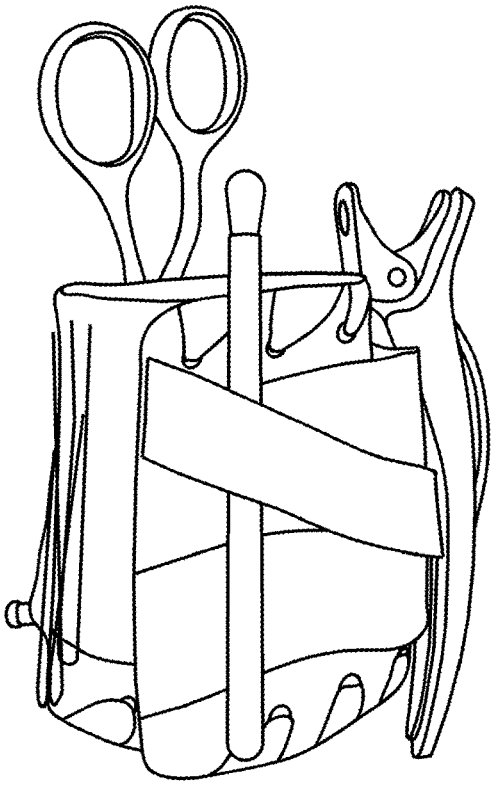

Similar to the wristband 10 of FIGS. 1 through 4, the wristband 110 represented in FIGS. 5 through 9 is intended to be worn on the forearm and in particular adjacent and preferably over the wrist. The wristband 110 incorporates an additional sleeve 26 at a location corresponding to the region 62 of the wristband 10 of FIGS. 1 through 4. The sleeves 26, 28, 30, and 32 differ from the sleeves of the wristband 10 by differing in length and width relative to each other to accommodate and secure implements of various different sizes and types, as evident from FIGS. 8 and 9. In addition, the sleeves 26, 28, 30, and 32 of the wristband 110 have tapered shapes, with the larger opening of each sleeve 26, 28, 30, and 32 being located adjacent the longer proximal edge 24 of the body 12 to facilitate placement of implements from the proximal end of the wristband 110 when worn on the wrist. FIG. 6 represents the wristband 110 as having three magnets 56, 58, and 60 attached to the body 12 to assist in securing implements within the sleeves 30 and 32 and securing relatively lighter implements on the region 64 of the outer surface 34 where neither a sleeve nor strap is located.

The straps 42 and 44 each span a single sleeve 30 or 32, whereas the remaining strap 40 spans two sleeves 26 and 28. As described for the wristband 10 of FIGS. 1 through 5, the straps 40, 42, and 44 of the wristband 110 are disposed at different angles relative to each other and therefore are not parallel to each other. When worn on the left wrist with the shorter distal edge 22 closer to the hand, the loop 40 is located over the ulna of the forearm, the loop 44 is located over the radius, and their respective orientations facilitate the user's ability to withdraw an implement from the loop 52 located over the radius by pulling the implement in a distal direction toward the hand and in a generally medial direction, and to withdraw an implement from the loops 46 and 48 located over the ulna by pulling the implement in a generally medial but proximal direction away from the hand, as indicated by the arrows in FIG. 7.

Finally, the wristband 110 is shown to incorporate lacing 68 along its edges 22 and 24 that, in part is decorative, but in addition provides means for causing the edges 22 and 24 to project from a plane containing the body 12. As such, when the wristband 110 is worn with its inner surface 36 contacting the user's forearm, the lacing 68 serves to raise the edges 22 and 24 so that implements secured in its sleeves 26, 28, 30, and 32 are lifted away from the wearer's skin. In place of the lacing 68, the wristband 110 could make use of grommets or any other components that are capable of raising the edges 22 and 24 away from the wearer's arm.

Figure 10:
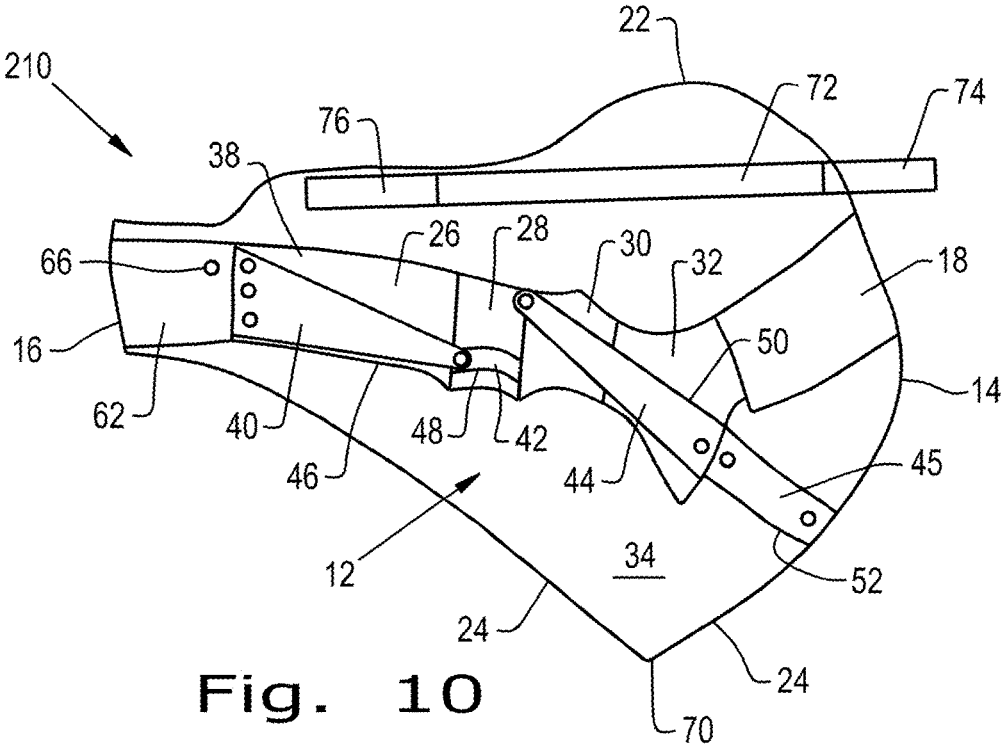
FIGS. 10 and 11 schematically represent front and rear views of a third embodiment of a band configured to secure implements and tools of various types and suitable for use in the beauty industry.
Figure 11:
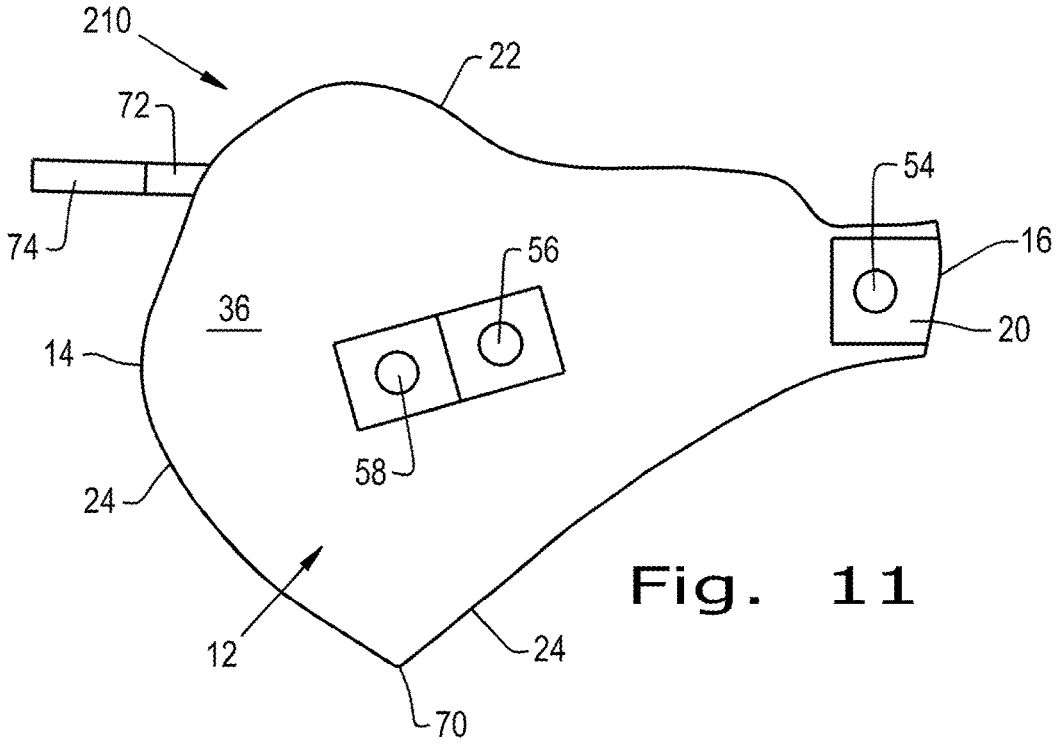
Figure 12:
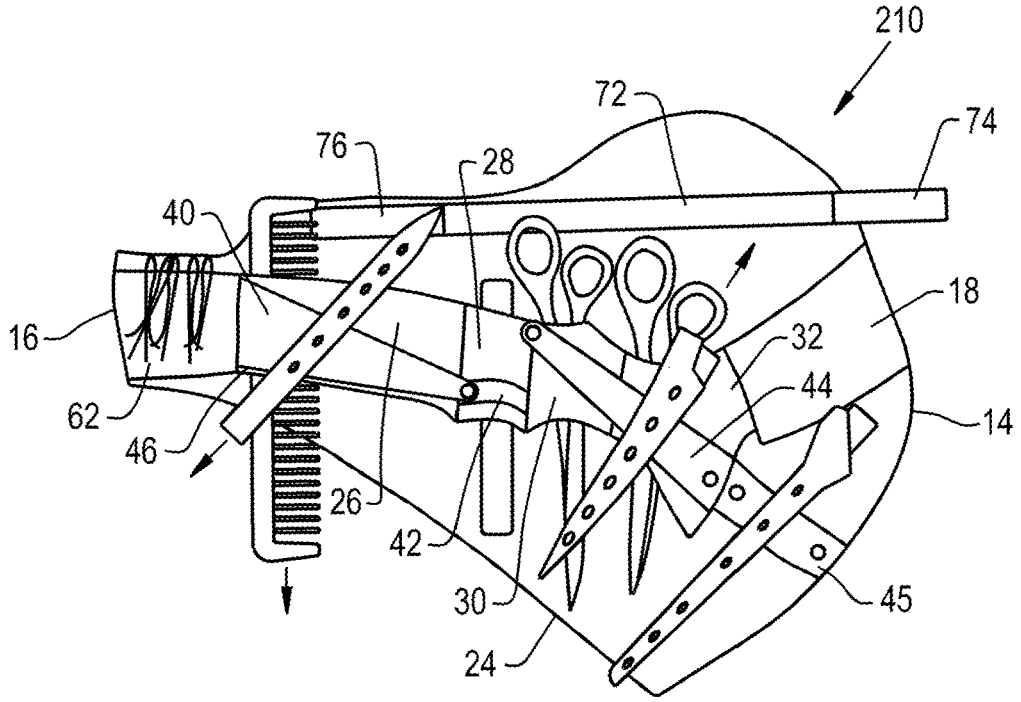
FIG. 12 schematically represents a variety of implements and tools secured to the band of FIGS. 10 and 11.

The peripheral shape of the main body 12 of the wristband 210 represented in FIGS. 10 through 12 differs from the bodies 12 of the wristbands 10 and 110 shown in FIGS. 1 through 9. Similar to the prior bodies 12, the body 12 of the wristband 210 is in the form of a flat panel or sheet having a maximum longitudinal dimension that is greater than its maximum lateral width, has oppositely-disposed first and second longitudinal ends 14 and 16 that can be joined together, for example, with complementary hook-and-loop fasteners 18 and 20 or other suitable temporary fasteners, and first and second longitudinal edges 22 and 24 that are laterally spaced apart from each other. As shown, the edges 22 and 24 have arcuate portions and are shaped to confer an ornamental appearance to the wristband 210 when worn by a user, with the longer proximal edge 24 defining a vertex that extends toward the elbow when the wristband 210 is worn on the forearm.

The wristband 210 incorporates four sleeves 26, 28, 30, and 32 and, in addition to the three straps 40, 42, and 44 of the prior embodiments, incorporates a fourth strap 45 such that four loops 46, 48, 50, and 52 are provided. The sleeves 26, 28, 30, and 32 differ in length and width relative to each other to accommodate and secure implements of various different sizes and types, as evident from FIG. 12. The straps 40 and 42 each span a single sleeve 26 or 28, whereas the strap 44 spans two sleeves 30 and 32. As described for the wristbands 10 and 110 of FIGS. 1 through 9, the straps 40, 42, 44, and 45 of the wristband 210 are disposed at different angles relative to the edges 22 and 24 of the body 12 and therefore are not parallel to each other. When worn on the left wrist with the shorter distal edge 22 closer to the hand, the loop 40 is located over the ulna of the forearm, the loops 44 and 45 are located over the radius, and their respective orientations facilitate the user's ability to withdraw an implement from the loops 50 and 52 located over the radius by pulling the implement in a distal direction toward the hand and in a generally medial direction, and to withdraw an implement from the loop 46 located over the ulna by pulling the implement in a generally medial but proximal direction away from the hand, as indicated by the arrows in FIG. 12. The sleeve 26 is similarly configured so that an implement can be readily placed and withdrawn from the proximal side of the wristband 210, as indicated by an arrow in FIG. 12.

FIG. 11 represents the wristband 210 as having three magnets 54, 56, and 58 attached to the body 12. As evident from FIG. 12, the magnets 54, 56, and 58 assist in securing implements within the sleeves 32 and 33 and securing relatively lighter implements on the region 64 of the outer surface 34 where neither a sleeve nor strap is located.

Whereas the exposed surface areas of each wristband 10 and 110 between its material strip 38 and edges 22 and 24 and extending between the longitudinal ends 14 and 16 are approximately equal to each other, the contour of the longer proximal edge 24 of the wristband 210 increases the surface area of the body 12 between the material strip 38 and proximal edge 24, such that implements placed in the sleeves 28, 30, and 32 are less likely to contact the wearer's skin, as evident from FIG. 12.

Finally, the wristband 210 is shown to incorporate an additional strap 72 attached at one of its ends to the body 12 adjacent the distal edge 22. The strap 72 is equipped with complementary hook-and-loop fasteners (or other suitable releasable fasteners) at its attached end and at a free end of the strap 72 to enable the strap 72 to be wrapped around the user's wrist as a wrist strap to promote a conformal fit of the wristband 210 around the user's wrist. The strap 72 inhibits the wristband 210 from slipping on the forearm as implements are placed in and removed from the sleeves 28, 30, and 32 and loops 46, 48, 50, and 52, particularly if the implement is secured with one of the magnets 54, 56, and 58.

While the invention has been described in terms of particular embodiments, it should be apparent that alternatives could be adopted by one skilled in the art. For example, the wristbands 10, 110, and 210 and their components could differ in appearance and construction from the embodiments described herein and shown in the drawings, functions of certain components could be performed by components of different construction but capable of a similar (though not necessarily equivalent) function, and various materials could be used in the fabrication of the wristbands 10, 110, and 210 and/or their components. In addition, the invention encompasses additional or alternative embodiments in which one or more features or aspects of the different disclosed embodiments may be combined. Accordingly, it should be understood that the invention is not necessarily limited to any embodiment described herein or illustrated in the drawings. It should also be understood that the phraseology and terminology employed above are for the purpose of describing the illustrated embodiments, and do not necessarily serve as limitations to the scope of the invention. Therefore, the scope of the invention is to be limited only by the following claims.

The invention claimed is:

1. A band configured for holding implements and tools when the band is secured around an arm of a user, the band comprising:

a body delimited by oppositely-disposed first and second longitudinal ends and by first and second edges that are between the first and second longitudinal ends and spaced apart from each other in a lateral direction of the body, the first and second edges each having arcuate portions and, upon fastening the first and second longitudinal ends together, the body acquires a circular shape having first and second axial ends that are defined respectively by the first and second edges, the first axial end being larger than the second axial end;

means for releasably securing the first and second longitudinal ends together;

sleeves located on an outer surface of the body and arranged side-by-side in a row so that each sleeve extends laterally across the outer surface, each of the sleeves having opposite ends that are open to permit an implement or tool to be placed therein from either of the opposite ends and protrude from both of the opposite ends; and straps secured to the body and sized to accommodate and secure implements or tools of different sizes, at least some of the straps spanning one or more of the sleeves, the straps being disposed at different angles relative to the first and second edges of the body so as not to be parallel to each other.

2. The band according to claim 1, wherein the first and second edges each have an arcuate shape along an entire extent thereof between the first and second longitudinal ends, the first edge being longer than the second edge so that, upon fastening the first and second longitudinal ends together with the releasably securing means, the circular shape of the body is a frustoconical shape.

3. The band according to claim 1, wherein the sleeves are arranged side-by-side in a single row, are parallel to each other, and are perpendicular to the first and second edges of the body.

4. The band according to claim 1, wherein the outer surface of the body has exposed surface areas between the sleeves and each of the first and second edges and extending between the first and second longitudinal ends, and the exposed surface areas are approximately equal.

5. The band according to claim 1, wherein the outer surface of the body has exposed surface areas between the sleeves and each of the first and second edges and extending between the first and second longitudinal ends, and a first of the exposed surface areas between the sleeves and the first edge is larger than a second of the exposed areas between the sleeves and the second edge.

6. The band according to claim 1, wherein the sleeves are formed by a strip that is attached to the outer surface of the body and has a lateral width that is less than a lateral width of the body.

7. The band according to claim 6, wherein the outer surface of the body has exposed surface areas between the strip and each of the first and second edges and extending between the first and second longitudinal ends, and the exposed surface areas are approximately equal.

8. The band according to claim 6, wherein the outer surface of the body has exposed surface areas between the strip and each of the first and second edges and extending between the first and second longitudinal ends, and a first of the exposed surface areas between the strip and the first edge is larger than a second of the exposed areas between the strip and the second edge.

9. The band according to claim 1, wherein the sleeves have equal lengths and widths.

10. The band according to claim 1, wherein the sleeves differ in length and width relative to each other.

11. The band according to claim 1, further comprising at least one magnet secured to the body and aligned with a first of the sleeves so as to be capable of magnetically securing a magnetic implement or tool in the first sleeve.

12. The band according to claim 1, further comprising:

at least one surface region of the outer surface that does not have a sleeve or strap thereon; and a magnet secured to the body and aligned with the surface region so as to be capable of magnetically securing a magnetic implement or tool on the surface region.

13. The band according to claim 12, wherein the surface region is disposed at one of the first and second longitudinal ends of the body.

14. The band according to claim 1, wherein the body is a flat panel or sheet.

15. The band according to claim 14, wherein the body has a maximum longitudinal dimension that is greater than a maximum lateral width thereof.

16. The band according to claim 14, further comprising means disposed along the first and second edges for causing the first and second edges to project from a plane containing the body.

17. The band according to claim 14, wherein the causing means comprises lacing disposed along the first and second edges.

18. The band according to claim 1, further comprising a wrist strap disposed along the second edge, the wrist strap having a first end attached to the body, an oppositely-disposed free end, and complementary fastener means at the first and free ends.

19. The band according to claim 1, wherein the band is a wristband.

20. A method of using the band of claim 1, the method comprising:

wrapping the band around a user's forearm adjacent the wrist thereof such that the second edge of the body is adjacent the wrist and the body acquires the circular shape thereof;

securing the first and second longitudinal ends of the body together with the releasably securing means and so that the first and second longitudinal ends are located at an anterior side of the forearm and the wrist;

placing a first implement or tool in a first of the sleeves so that the first implement or tool protrudes from both of the opposite ends of the first sleeve; and placing a second implement or tool in a first of the straps, the first strap orienting the second implement or tool at a different angle relative to the first implement or tool.

* * * * *